United States Patent [19]

Davis et al.

[11] 4,278,345

[45] Jul. 14, 1981

[54] DRUM CLEANING APPARATUS

[75] Inventors: Austin E. Davis; Raymond G. Cormier; Christopher A. Caggiula, all of Nashua, N.H.

[73] Assignee: Nashua Corporation, Nashua, N.H.

[21] Appl. No.: 75,980

[22] Filed: Sep. 17, 1979

[51] Int. Cl.[3] ..... G03G 21/00; G03G 15/10

[52] U.S. Cl. ..... 355/15; 355/10

[58] Field of Search ..... 355/3 R, 10, 15

[56] References Cited

U.S. PATENT DOCUMENTS

| | | | |
|---|---|---|---|
| Re. 28,568 | 10/1975 | Saito et al. | 355/15 |
| 3,654,654 | 4/1972 | Abreu et al. | 15/1.5 |
| 3,656,200 | 4/1972 | Riley | 15/256.52 X |
| 3,759,220 | 9/1973 | Saito et al. | 355/15 X |
| 4,032,229 | 6/1977 | Tani et al. | 355/15 |
| 4,077,711 | 3/1978 | Akamatsu | 355/10 |
| 4,080,059 | 3/1978 | Tani et al. | 355/15 |

*Primary Examiner*—Fred L. Braun
*Attorney, Agent, or Firm*—Kenway & Jenney

[57] ABSTRACT

An apparatus for cleaning residual toner from the photosensitive surface of the rotating drums of photocopying machines. The cleaning assembly includes at least a cleaning roller and a cleaning blade which are moveable from an inoperative position spaced away from the photosensitive surface to an operative position in contact with the surface. In operation, the rotating drum begins its rotation while the roller and blade are in their inoperative position. The drum surface contacts liquid developer solution at the developing station. The roller and blade contact the drum after a predetermined time duration and therefore contact a wetted drum surface so as to avoid possible damage to the photosensitive surface and the cleaning members. A delay arrangement directs developer to the cleaning blade and roller when they are in their operative position contacting the drum.

4 Claims, 3 Drawing Figures

DRUM CLEANING APPARATUS

BACKGROUND OF THE INVENTION

This invention relates generally to photocopying machines, and, more particularly, to the cleaning station of a photocopy machine employing liquid developer. The cleaning stations of photocopying machines employing liquid developer generally include a cleaning blade made of a resilient material, and, in many commercial machines, a cleaning roller made of a sponge material. The cleaning roller first loosens residual developer remaining on the photosensitive drum after the developed image is transferred to the copy medium, and the resilient blade scrapes or wipes the developer from the drum thereafter. If the cleaning blade and roller remain in contact with the drum surface during the time when the drum is not rotating, that is, when the copier is either on but not being used or has been turned off, for example, during a weekend, the liquid developer adhering to the blade or roller will dry out. When the copier is next started, the dried-on toner remaining on the cleaning surfaces could, in some instances adversely affect operation of the blade, the roller, and/or the photosensitive surface. The same possibility exists even if the blade and roller are lifted away from the photosensitive surface during noncopying times. In this circumstance, the dried toner could adversely affect the blade, roller and photosensitive surface when they are brought into contact with one another.

It is, therefore, an object of the present invention to provide apparatus for avoiding possible damage to the cleaning station and/or the photosensitive surface of a photocopying machine caused by the action of toner that has dried on either the photosensitive drum or the cleaning blade or cleaning roller. Another object of the invention is to avoid the possibility of damage to the cleaning station of the photosensitive drum of a photocopying machine and to provide apparatus which is simple to implement and which is reliable.

Yet another object of the invention is to avoid possible damage to the drum surface and to the cleaning roller and cleaning blade of a liquid developer photocopier and to provide apparatus which can be retrofitted to existing photocopying machines.

SUMMARY OF THE INVENTION

The photocopying apparatus disclosed herein has a rotatable drum bearing thereon a photosensitive surface and apparatus for creating on the photosensitive surface an electrostatic latent image. A system is provided for contacting the latent image with a liquid developer at a developing station both for developing the latent image and for wetting the photosensitive surface before it is cleaned. Next, apparatus is provided for transferring the developed latent image to a copying medium followed thereafter by an assembly for cleaning residual developer from the photosensitive surface after transfer of the developed image to the copy medium. The invention features an assembly for cleaning the photosensitive surface having at least a cleaning blade and a cleaning roller. Mechanisms are provided for moving the blade and the roller between an inoperative position spaced away from the photosensitive surface and an operative position in contact with the photosensitive surface. A drum rotation assembly rotates the drum, and the moving mechanism and the contacting system cooperate to move the blade and the roller from the inoperative position to the operative position a predetermined time after initiation of drum rotation so that the blade and the roller, when they are in their operative position, contact a drum photosensitive surface which has been wetted with liquid developer from the developing station. A system is also provided for supplying the liquid developer to the cleaning assembly only when the blade and the roller are in their operative position in contact with the photosensitive surface.

In a preferred embodiment of the invention disclosed herein, the apparatus further includes a pump for pumping developer solution from the developing station to the cleaning assembly and, in addition, control apparatus for initiating operation of the pump prior to moving the blade and the roller to their operative position in contact with the photosensitive drum surface. In this embodiment, the system for supplying the liquid developer to the cleaning assembly only when the blade and the roller are in their operative position includes a conduit and the pump pumps the developer from the developing station to the cleaning assembly through the conduit. The conduit includes a section of increased volume such as an accumulator of increased cross-sectional area in relation to the remaining part of the conduit so that filling of the accumulator delays the delivery of the developer to the cleaning assembly until the blade and the roller are in their operative position.

DESCRIPTION OF THE PREFERRED EMBODIMENT

Figure 1:
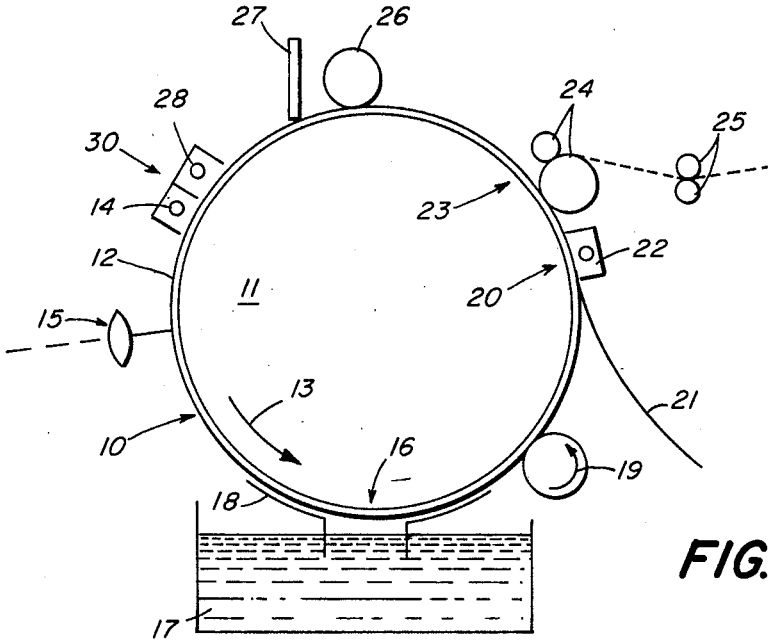
FIG. 1 is a schematic elevation view of a typical photocopying machine.

Referring first to FIG. 1, a typical photocopying machine 10 in which the present invention can be employed has a rotating drum 11 with a photosensitive surface 12 thereon rotating in the direction indicated by an arrow 13. A charge corona 14 located in close proximity to the drum 11 charges the photosensitive surface 12 to about +1000 volts. An optical system indicated generally at 15 focuses an image onto the drum 11 and the light selectively discharges the surface 12 so as to form a latent image comprising a pattern of electrical charges on the surface 12. The rotating drum 11 transports the latent image to a developing station 16 where a liquid developer 17 having a negatively charged toner will contact the latent image to develop it. A development electrode 18 having a positive electrostatic charge of appropriate magnitude is located close to the surface 12 and serves to counteract any residual background voltage remaining on the drum surface. A counter-rotating metering roll 19 removes excess liquid. The surface 12, bearing the now-developed image, proceeds to a transfer station 20 where the image will be transferred to a copy material 21. A transfer corona 22, also in close proximity to the drum surface 12, applies a positive charge to the backside of the copy material 21 and causes the toner particles to be attracted to the surface of the copy material 21. During this process, the copy material 21 makes actual contact with the surface 12 and then must be removed from the surface at 23 and be led away from the drum 11 along a path defined by rollers 24 and 25. After transfer, there generally remains on the drum a residue of liquid developer. The surface 12 is cleaned of this residue by a cleaning roller 26 and a cleaning blade 27. Finally, the surface is electrically neutralized prior to the next copying cycle by a high alternating voltage, for example 4800 volts, applied to a discharge corona 28. Both the charge corona 14 and the discharge corona 28 are mounted within a corona assembly 30.

Figure 2:
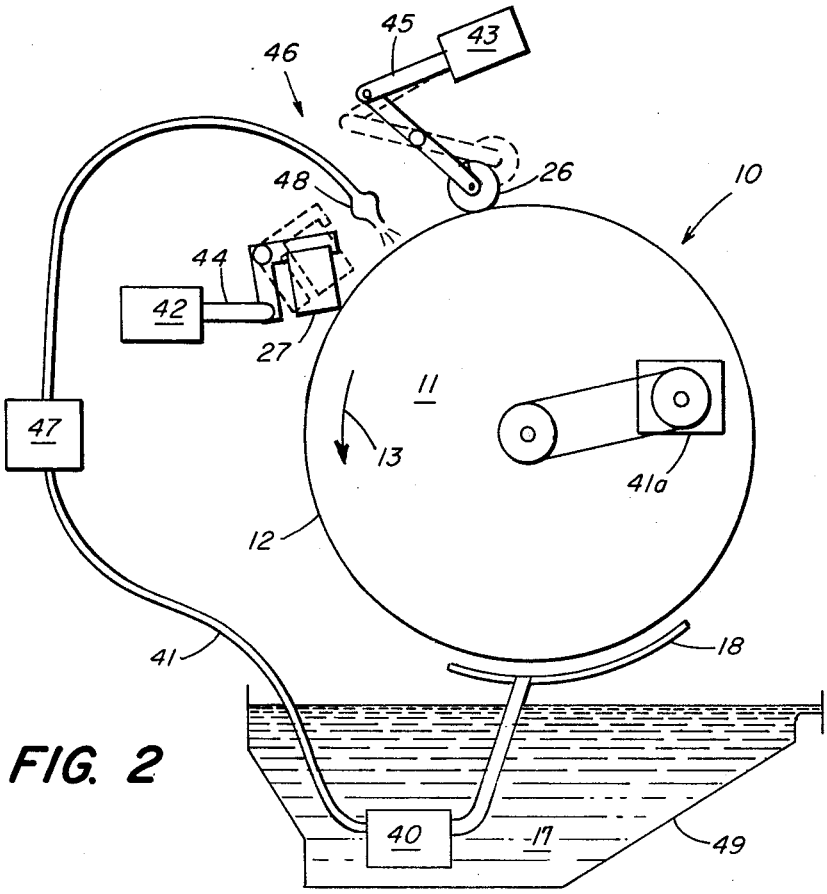
FIG. 2 is a schematic elevation view of the drum cleaning apparatus according to the present invention.

Referring now to FIG. 2, the photocopying machine is represented generally at 10. As soon as the drive power is applied to the photocopying machine 10, a pump 40 begins to pump the liquid developer 17 both to the electrode 18 and through a conduit 41. At the same time, the main drive motor 41*a* begins to rotate the drum 11 in the direction of the arrow 13. At this time, the cleaning roller 26 and the cleaning blade 27 are in their inoperative position spaced apart from the rotating drum 11. The inoperative position of both the cleaning roller 26 and the cleaning blade 27 are shown in phantom. Thus, as the drum 11 begins to rotate, it contacts liquid developer in the vicinity of the electrode 18, thereby wetting the photosensitive surface 12 with the liquid developer 17. The drum 11 continues to rotate for approximately three-fourths of a revolution carrying the wetted surface 12 past a cleaning station 46. At this time, solenoids 42 and 43 are activated by a timing circuit which will be described in detail in conjunction with FIG. 3. When the solenoids 42 and 43 are activated, their respective plungers 44 and 45 are pulled into the solenoids causing the cleaning blade 27 and the cleaning roll 26 to pivot into contact with the photosensitive surface 12. Thus, at the time that the cleaning roller 26 and the cleaning blade 27 move into their operative position in contact with the photosensitive surface 12, the surface 12 has been wetted with the liquid developer 17 which has been carried up to the cleaning station 46 from the vicinity of the electrode 18.

All the while, the pump 40 has been pumping the liquid developer 17 through the conduit 41 toward the cleaning station 46. Disposed between sections of the conduit 41 is an accumulator 47 of increased cross-sectional area as compared to the conduit 41. The accumulator 47 must fill up with developer fluid 17 before any of the fluid is delivered to the cleaning station 46. The delay resulting from the filling of the accumulator 47 prevents the delivery through the nozzle 48 of the liquid developer 17 until after the cleaning roller 26 and the cleaning blade 27 are in their operative position in contact with the photosensitive surface 12. This delay prevents the developer 17 from splashing underneath the roller 26 and the blade 27 which would be the case if the developer liquid 17 were delivered before the roller 26 and the blade 27 were moved into their operative positions.

After the cleaning roller 26 and the cleaning blade 27 have moved into the operative position when the photocopier is first turned on, they remain there as the drum 11 rotates for a period of time sufficient to clean the drum 11. A typical time period is from 3–35 seconds. The cleaning roller 26 is driven (by means not shown) to rotate in the same sense as the drum 11 so that at their area of contact the surface 12 and the surface of the roller 26 are moving opposite directions, thereby to provide good cleaning action to loosen any toner which may have become dried onto the photosensitive surface 12. After the cleaning roller 26 has dislodged the toner particles, the surface 12 is wiped clean by the cleaning blade 27. After the photosensitive surface 12 has been cleaned after the photocopier is first turned on, or after a copy cycle, the solenoids 42 and 43 are deactivated causing the cleaning roller 26 and the cleaning blade 27 to return to their inoperative positions spaced away from the photosensitive surface 12. At the same time, the pump 40 is turned off, allowing the developer fluid 17 to flow by gravity out of the accumulator 47 back into the developer reservoir 49. Thus, after the end of the cleaning cycle, the cleaning roller 26 and the cleaning blade 27 are both in their inoperative position and the accumulator 47 has emptied into the reservoir 49.

Figure 3:
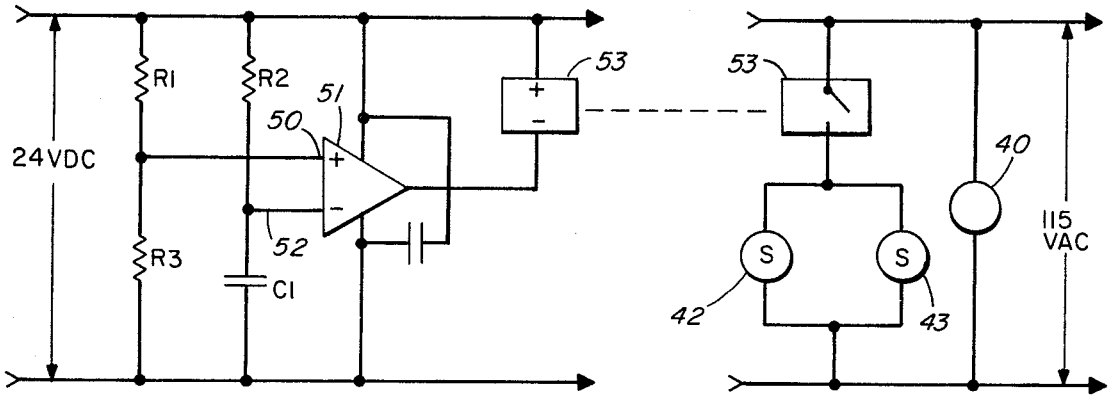
FIG. 3 is an electrical schematic diagram of the timing circuit which controls the drum cleaning apparatus of this invention.

The timing circuit which delays the movement of the cleaning roller 26 and the cleaning blade 27 from the inoperative to the operative position is shown in FIG. 3. When the main power is truned on, 24 volts D.C. is applied across the left hand portion of FIG. 3 and 115 volts A.C. appears across the right hand portion of the circuit in FIG. 3. Note that the 115 volts A.C. immediately appears across the pump 40 which begins to pump the liquid developer 17. As soon as the 24 volts D.C. appears, a capacitor C1 begins to charge. Initially, the voltage at a noninverting input 50 to an operational amplifier 51 is higher than that at an inverting input 52. This causes the output voltage of the operational amplifier 51 to be high which causes a relay 53 to be in its off state. When the capacitor C1 has become charged so that the voltage at the input 52 is greater than the voltage at the input 50, the output of the operational amplifier 51 becomes low, which turns on the relay 53. The time interval before the relay 53 is turned on is determined by the relative values of the resistors R1, R2, R3 and the capacity of the capacitor C1. A typical delay period is approximately 1 second which is enough time, in the illustrated embodiment, for the rotating drum to complete approximately three-fourths of a revolution. Thus, the cleaning blade and roller, when they move to their operative position, contact a wet photosensitive surface.

When the relay 53 is turned on, 115 volts A.C. is applied across the solenoids 42 and 43, causing their plungers to be pulled in, thereby moving the cleaning roller and cleaning blade to their operative positions as described hereinbefore.

It is thus seen that the objects of this invention have been achieved in that there has been disclosed cleaning apparatus which prevents damage to the photosensitive surface and to the cleaning roller and cleaning blade. This is accomplished by moving the photosensitive surface before moving the cleaning roller and cleaning blade from their inoperative positions to operative positions in contact with the photosensitive surface. In addition, the delivery of developer fluid to the cleaning station near the cleaning roller and cleaning blade is delayed until the cleaning roller and cleaning blade are moved into their operative position, thereby preventing the splashing of fluid beneath the roller and the blade.

SUMMARY OF THE MAJOR ADVANTAGES OF THE INVENTION

This invention advantageously provides an apparatus for use in a liquid developer photocopying machine which avoids possible damage to the cleaning blade, the cleaning roller and the photosensitive surface caused by dried-on toner particles. The invention avoids the possibility of developer splashing beneath the roller or blade by application of the developer liquid at the cleaning station before the roller and the blade are moved from their inoperative position to the operative position in contact with the photosensitive surface. This cleaning apparatus further advantageously provides a system which has minimum electrical and timing complexities.

Additions, subtractions, deletions and other modifications of the disclosed preferred embodiment of this invention will be obvious to those skilled in the art and are intended to be within the scope of the appended claims.

What is claimed is:

1. A photocopy apparatus having:

a rotatable drum bearing thereon a photosensitive surface;

means for creating on said surface an electrostatic latent image;

means for contacting said photosensitive surface with a liquid developer at a developing station for developing said latent image;

means for transferring the developed latent image to a copy medium;

means for cleaning residual developer from said photosensitive surface after transfer of said developed image to the copy medium;

said cleaning means having at least a cleaning blade and a cleaning roller, means for moving said blade and said roller between an inoperative position spaced away from said photosensitive surface and an operative position in contact with said photosensitive surface;

means for rotating said rotatable drum, said contacting means and said moving means cooperatively adapted to move said blade and said roller from the inoperative position to the operative position a predetermined time after the initiation of drum rotation whereby said blade and said roller when they are in their operative position contact a said photosensitive surface which has been wetted with said liquid developer at said developing station; and means for supplying said liquid developer directly to said cleaning means only when said blade and said roller are in their operative position in contact with said photosensitive surface.

2. The apparatus of claim 1 further comprising:

a pump for pumping developer solution from said developing station to said cleaning means; and means for initiating operation of said pump prior to moving said blade and said roller to their operative position in contact with said drum.

3. The apparatus of claim 1 wherein said means for supplying said liquid developer to said cleaning means only when said blade and said roller are in their operative position comprises:

conduit means; and a pump for pumping said developer from said developing station to said cleaning means through said conduit means;

said conduit means including an accumulator of increased cross-sectional area in relation to the remainder of said conduit means whereby the filling of said accumulator delays the delivery of said developer to said cleaning means until said blade and said roller are in their operative position.

4. A photocopying apparatus having:

a rotatable drum bearing thereon a photosensitive surface;

means for creating on said surface an electrostatic latent image;

means for contacting said photosensitive surface with a liquid developer at a developing station for developing said latent image;

means for transferring the developed latent image to a copy medium;

means for cleaning resiudal developer from said photosensitive surface after transfer of said developed image to the copy medium;

said cleaning means having at least a cleaning blade and a cleaning roller;

means for moving said blade and said roller between an inoperative position spaced away from said photosensitive surface and an operative position in contact with said photosensitive surface;

means for rotating said rotatable drum;

said contacting means and said moving means cooperatively adapted to move said blade and said roller from the inoperative position to the operative position a predetermined time after the initiation of drum rotation whereby said blade and said roller when they are in their operative position contact a said photosensitive surface which has been wetted with said liquid developer at said developing station; and means for supplying said liquid developer to said cleaning means only when said blade and said roller are in their operative position in contact with said photosensitive surface comprising:

conduit means; and a pump for pumping said developer to contact said surface at said developing station and to said cleaning means through said conduit means;

said conduit means including a section of increased volume whereby the filling of said section of increased volume delays the delivery of said developer to said cleaning means until said blade and said roller are in their operative position.

* * * * *

Notice of Adverse Decision in Interference

In Interference No. 101,212, involving Patent No. 4,278,345, A. E. Davis, R. G. Cormier and C. A. Caggiula, DRUM CLEANING APPARATUS, final judgment adverse to the patentees was rendered Oct. 26, 1984, as to claims 1–4.

[*Official Gazette January 29, 1985.*]